US007648431B1

(12) United States Patent
Kinkead

(10) Patent No.: US 7,648,431 B1
(45) Date of Patent: Jan. 19, 2010

(54) TARGET RECEPTACLE FOR CATCHING BALLS

(76) Inventor: Roy Kinkead, 7 Cartwright Rd., Stony Point, NY (US) 10980

( * ) Notice: Subject to any disclaimer, the term of this patent is extended or adjusted under 35 U.S.C. 154(b) by 120 days.

(21) Appl. No.: 11/974,585

(22) Filed: Oct. 13, 2007

(51) Int. Cl.
*A63B 69/00* (2006.01)

(52) U.S. Cl. ..... 473/454; 473/422; 473/451; 473/431

(58) Field of Classification Search ..... 473/454, 473/455, 456, 422, 431, 451; 124/6
See application file for complete search history.

(56) References Cited

U.S. PATENT DOCUMENTS

| | | | | | |
|---|---|---|---|---|---|
| 3,172,661 | A * | 3/1965 | Scheemaeker | ..... | 473/454 |
| 3,194,556 | A * | 7/1965 | Vinson | ..... | 473/436 |
| 3,233,899 | A * | 2/1966 | Hershberger | ..... | 473/431 |
| 3,506,266 | A * | 4/1970 | Wintersteen | ..... | 273/392 |
| 3,656,750 | A * | 4/1972 | Meunier | ..... | 473/454 |
| 4,191,374 | A * | 3/1980 | Kulesza et al. | ..... | 473/436 |
| 4,883,272 | A * | 11/1989 | Lay | ..... | 473/436 |
| 4,978,121 | A * | 12/1990 | Larkey | ..... | 473/454 |
| 5,271,616 | A | 12/1993 | Grimaldi | ..... | 273/26 |
| 5,417,196 | A * | 5/1995 | Morrison et al. | ..... | 124/6 |
| 5,573,239 | A * | 11/1996 | Ryker et al. | ..... | 473/436 |
| 5,599,017 | A * | 2/1997 | Bixler et al. | ..... | 473/436 |
| 6,155,936 | A | 12/2000 | Dorr | ..... | 473/456 |
| 6,379,272 | B1 | 4/2002 | Gorgo et al. | ..... | 473/421 |
| 6,620,064 | B2 | 9/2003 | Nickerson | ..... | 473/431 |
| 6,776,732 | B2 * | 8/2004 | Parkinson et al. | ..... | 473/431 |
| 7,137,910 | B2 | 11/2006 | Ktson et al. | ..... | 473/431 |
| 7,207,893 | B1 * | 4/2007 | Louie | ..... | 473/166 |
| 7,278,934 | B2 * | 10/2007 | McBride et al. | ..... | 473/451 |
| 7,367,906 | B2 * | 5/2008 | Tien | ..... | 473/451 |

* cited by examiner

*Primary Examiner*—Mitra Aryanpour
(74) *Attorney, Agent, or Firm*—Goldstein Law Offices, P.C.

(57) ABSTRACT

A target receptacle, for use in practicing baseball, softball, and the like, having a main part and a base plate. The base plate is secured to a ground surface. The main part is rotatably mounted to the base, has an intake opening, and exit port, and a fully enclosed conduit connecting the intake opening and exit port. When a ball is thrown into the intake opening, it travels through the conduit and exits through the exit port.

9 Claims, 8 Drawing Sheets

TARGET RECEPTACLE FOR CATCHING BALLS

BACKGROUND OF THE INVENTION

The invention relates to a target receptacle for catching balls and safely returning it to the thrower. More particularly, the invention relates to a device that is utilized during the practice of baseball, softball, or the like, and acts as a target to catch balls thrown thereat so as to provide immediate feedback regarding the accuracy of the throw.

Becoming an accomplished baseball or softball player requires that a player develop and master a variety of skills. Among these skills are catching, fielding, base running, sliding, batting, and of course: throwing.

Accurately throwing the ball is among the most critical skills to master for a variety of reasons. When fielding a ball hit by an opposing batter, or even when relaying a ball thrown by another player, the accuracy of the throw helps determine the success of the play being attempted. In addition, when pitching, the speed, accuracy, and manner that the ball is thrown will together determine whether the batter can hit the pitch, or if a ball or strike is called by the umpire.

While many other skills can be practiced alone, it is difficult to properly practice throwing—while ascertaining accuracy—without another player. Truly, a major obstacle to developing pitching techniques is that you need a catcher willing to spend the hours necessary for practice and development of the skills required to be a successful pitcher in softball games. Most successful pitchers have had a friend or relation that was willing to sacrifice the time necessary to aid the pitcher in developing his/her skills. Conversely, without such help, the prospect of becoming a skilled pitcher is severely hampered.

Part of the skill of the pitcher to be developed is to throw the ball within the "strike zone" of the batter. The strike zone is commonly defined as that area above home plate, within the lateral edge boundaries of home plate, and generally between the knee area and arm-pit area of the batter. Skilled pitchers can direct the pitched ball within (or sometimes, when chosen strategically, outside of) the strike zone.

In addition, even when the pitcher has developed a satisfactory technique, the most common way of determining whether the pitcher is throwing accurately is by personal observation. It should be quite clear that mere personal observation oftens leaves significant doubt about whether a pitch is accurately thrown. In consideration of this point, one need only consider the frequency of disputes of the accuracy of calls made by even the most seasoned umpires while observing from an optimum position behind home plate.

U.S. Pat. No. 5,271,616 to Grimaldi discloses a pitching target apparatus that includes a pitching target suspended within a retaining chamber and a floor panel, which slopes toward one side to allow gravity to expel the ball.

U.S. Pat. No. 5,573,239 to Ryker et al. discloses a device to catch, determine accuracy and throw back a ball. Unfortunately Ryker employs considerable complexity and many moving parts and thus presents significant impracticalities.

U.S. Pat. No. 6,155,936 to Dorr discloses a baseball pitcher's practice target with ball return. Dorr, once again, requires a motorized mechanism to return the balls to the pitcher, and thus requires connection to a power source.

U.S. Pat. No. 6,379,272 to Gorgo et al. discloses a backstop and sports ball return assembly. Gorgo employs nets, a collection well, and a chute, and is extremely large, making it impractical for use during baseball or softball practice.

U.S. Pat. No. 6,620,064 to Nickerson discloses a return net device, purportedly for receiving, arresting, and returning a ball to a central collection point for pitched, thrown or batted balls in a ball practice system.

U.S. Pat. No. 7,066,845 to Joseph discloses a baseball training system and method. Joseph collects balls thrown within its nets, and throws them back using a motorized pitching machine.

U.S. Pat. No. 7,137,910 to Ktson discloses a rotating wheel return mechanism. Ktson catches balls within a pan below a backstop, and then returns them using a rotatable wheel that is affixed to a spindle and driven by a motor.

While these units may be suitable for the particular purpose employed, or for general use, they would not be as suitable for the purposes of the present invention as disclosed hereafter.

SUMMARY OF THE INVENTION

It is an object of the invention to produce a target receptacle that aids in the training of fledgling baseball and softball players. Accordingly, the target only "catches" baseballs thrown precisely at it's intake opening, thereby training players to throw with accuracy.

It is another object of the invention to provide a target receptacle that aids with pitching training. Accordingly, the intake opening is preferably sized and shaped to help train players to aim pitches within the strike zone.

It is a further object of the invention to provide a target receptacle that can be used by a player, practicing alone. Accordingly, the target receptacle is configured to return the ball to the player, and can also retain the balls it receives until they are manually retrieved by the player.

It is a still further object of the invention to provide a target receptacle that can withstand high-powered pitches. Accordingly, the target receptacle has a base plate that can be staked-down to the ground surface just prior to use.

It is yet another object of the invention to provide a target receptacle that is durable, and inexpensive to manufacture. Accordingly, the target receptacle can be inexpensively fabricated from durable plastic, and constructed from minimal components.

The invention is a target receptacle, for use in practicing baseball, softball, and the like, having a main part and a base plate. The base plate is secured to a ground surface. The main part is rotatably mounted to the base, has an intake opening, and exit port, and a fully enclosed conduit connecting the intake opening and exit port. When a ball is thrown into the intake opening, it travels through the conduit and exits through the exit port.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
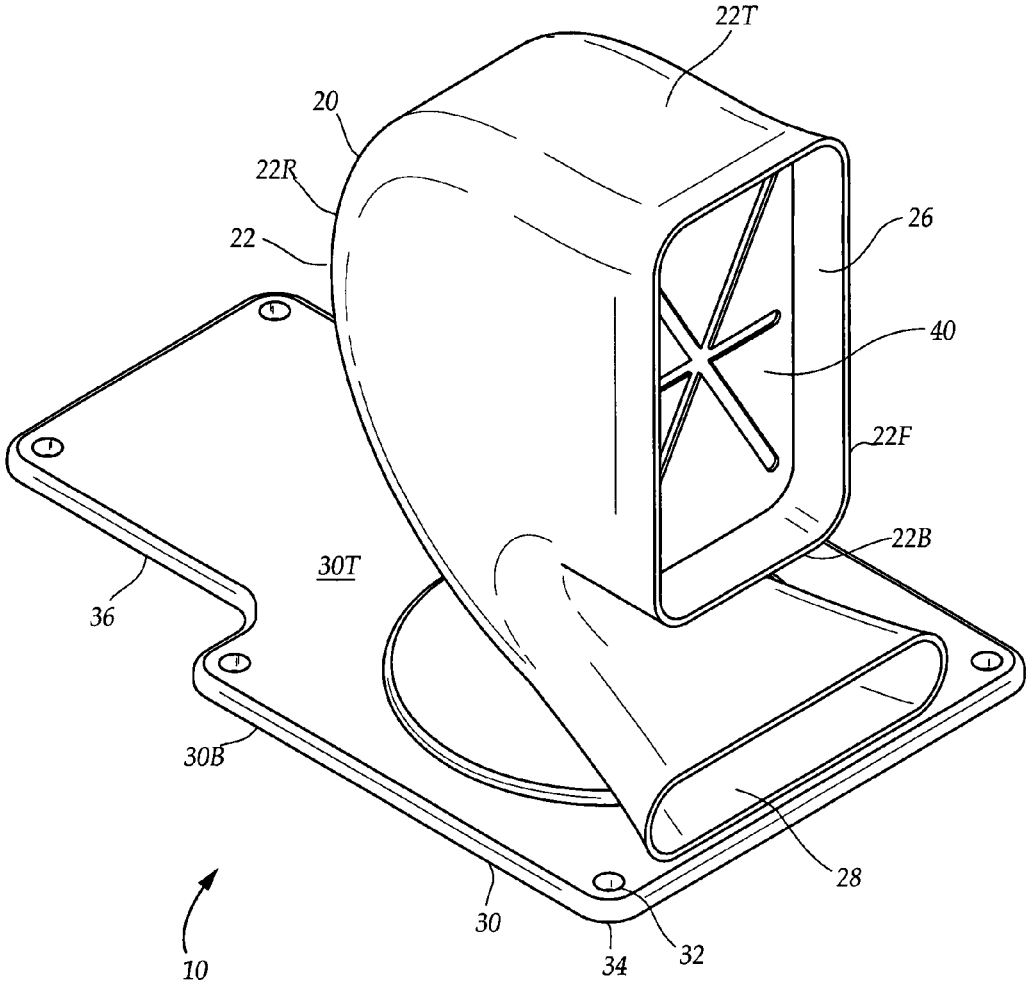
FIG. 1 is a diagrammatic perspective view, illustrating the present invention, per se.

FIG. 1 illustrates a target receptacle 10, according to the present invention, for use in practicing baseball, softball, and the like. At the onset, it should be noted that for the purposes of the discussion of the present invention, the terms "softball", and "baseball" are interchangeable. It should also be noted whether one, or the other term is used in any given context, the present invention can be used without limitation for either sport, and even other sports that involve practicing throwing skills. Accordingly, any such use of terminology is in no way limiting to the scope of the present invention.

The target receptacle 10 has a main part 20 and a base plate 30. The main part 20 includes an upper part 22, and a stand 24. The upper part 22 has a front 22F, a rear 22R, a top 22T, and a bottom 22B. The upper part 22 has an intake opening 26 located at the front 22F near the top 22T, and an exit port 28 located at the front 22F near the bottom 22B.

The base plate 30 has a top surface 30T and a bottom surface 30B. The base plate 30 also has a front 30F and rear 30R. The base plate 30 has a plurality of stake holes 32 which extend fully vertically from the top surface 30T to the bottom surface 30B. Accordingly, stakes can be extended through the stake holes 32 in the base plate 30 and into a ground surface beneath the base plate 30, to stabilize the target receptacle 10. Note that the base plate 30 has a substantially square main portion 34, and also has a rectangular support extension 36 that extends rearwardly from the rear 30R. The rectangular support extension 36 lends additionally stability to the target receptacle 10, especially when it is subjected to high-powered pitches. It should be noted that the base plate 30 is preferably sized so that when positioned over home plate, it won't enter the batter's box. Standardly, home plate is 17 inches by 17 inches, and the batter's box is positioned six inches laterally from home plate (on each side). It should be noted that the present invention is not limited to any particular dimensions. For the purposes of honoring this preference, however, the base plate 30 should be no wider than 29 inches.

As illustrated, the exit port 28 is flared laterally outwardly. This outward flare increases the possibly exit trajectory angles of the ball, thereby causing the player to "field" the ball as it is returned to the player. Accordingly, when used during pitching training, the target receptacle 10 can effectively simulate a "bunt", and can thereby train the pitcher to properly field the same.

Figure 2:
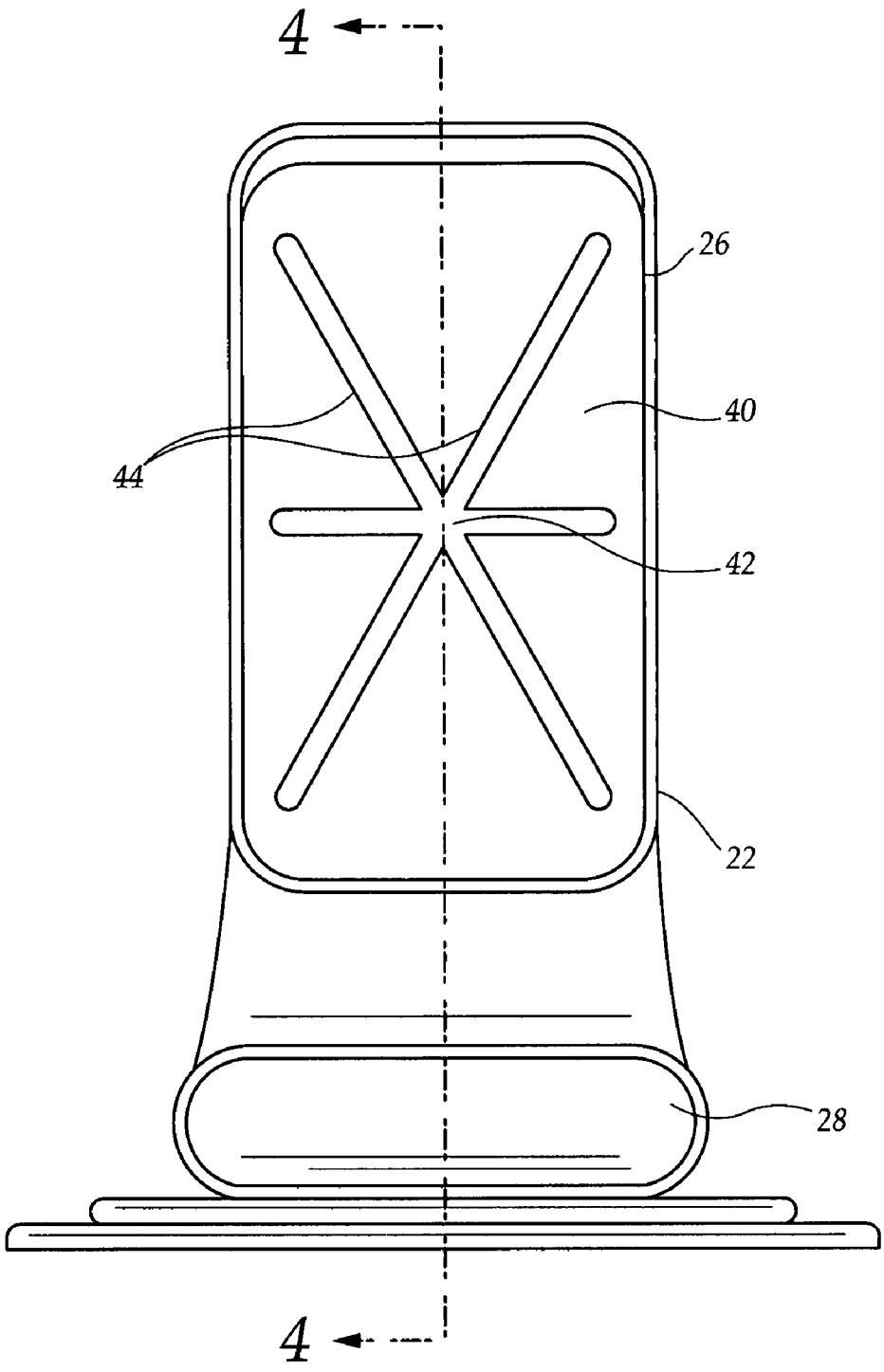
FIG. 2 is a front elevational view, illustrating the intake opening as well as the output port.

A membrane 40 is located within the intake opening 26. Referring now to FIG. 2, the membrane 40 has a center 42, and a plurality of radial cuts 44 extending outwardly from the center 42. The membrane is located just inside the intake opening 26 and substantially spans the intake opening 26. The membrane 40 is made of a flexible material, such as rubber, and is structured, including the radial cuts 44, so as to allow a ball to enter the upper part 22, and prevent it from bouncing out at an unexpected trajectory. In FIG. 2, it is clear that the intake opening 26 and exit port 28 are oriented in the same direction, having parallel axes. It is also apparent that the intake opening 26 is substantially rectangular in shape, greater in height than in width. Accordingly, it is highly desirable that the intake opening 26 is shaped and sized like the strike-zone of a player.

Figure 3:
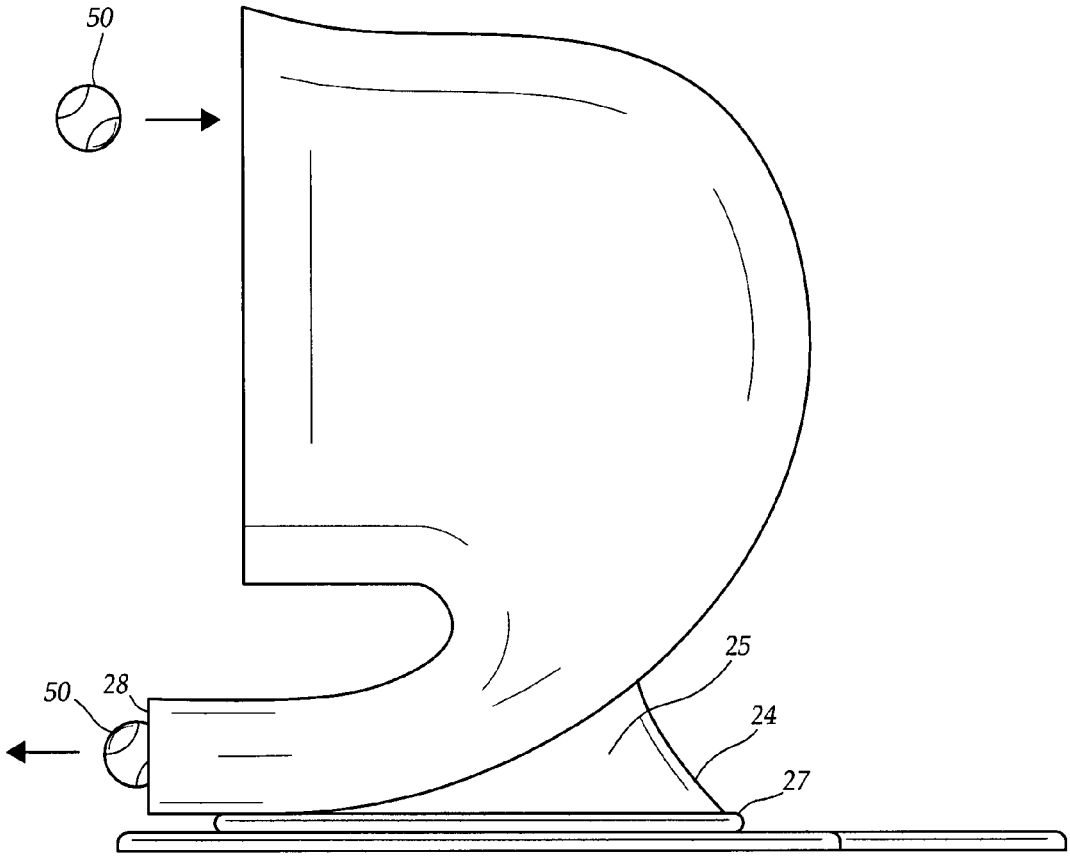
FIG. 3 is a side elevational view, illustrating baseballs entering the intake opening and leaving the exit port.
Figure 4:
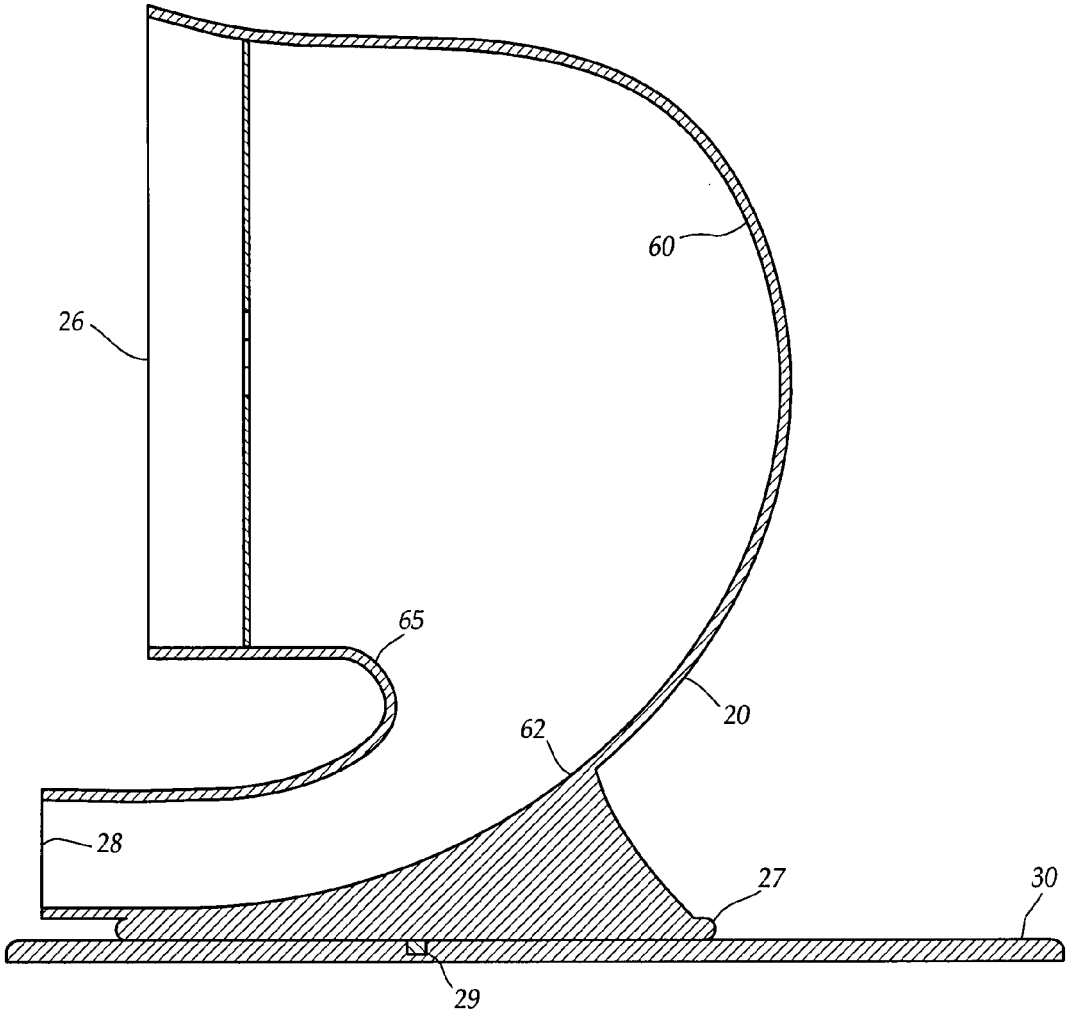
FIG. 4 is a cross sectional view, taken generally in the direction of line 4-4 in FIG. 2.

FIGS. 3 and 4 help illustrate the prime functionality of the target receptacle 10. In particular, from FIG. 3 it is clear that balls 50 are thrown so that they enter the intake opening 26, and then exit through the exit port 28. FIG. 4 helps illustrate how. In particular, a conduit 65 connects the intake opening 26 to the exit port, such that the intake opening 26 is in direct communication with the exit port 28. The conduit 65 is substantially U-shaped. Accordingly balls 50 that enter the intake opening 26 can travel fluidly from the intake opening 26 to the exit port 28, fully within the upper part 22. In particular, the upper part 22 is fully enclosed with solid walls between the intake opening 26 and exit port 28. The conduit 65 has a concave rear wall 60, which is curved continuously through a lower transition curve 62, toward the exit port 28 helps achieve this fluid motion. In particular, when the ball strikes the rear wall 60 its motion is translated by the rear wall 60 so as to smoothly follow the rear wall, through the transition curve 62 and toward the exit port 28.

Figure 5:
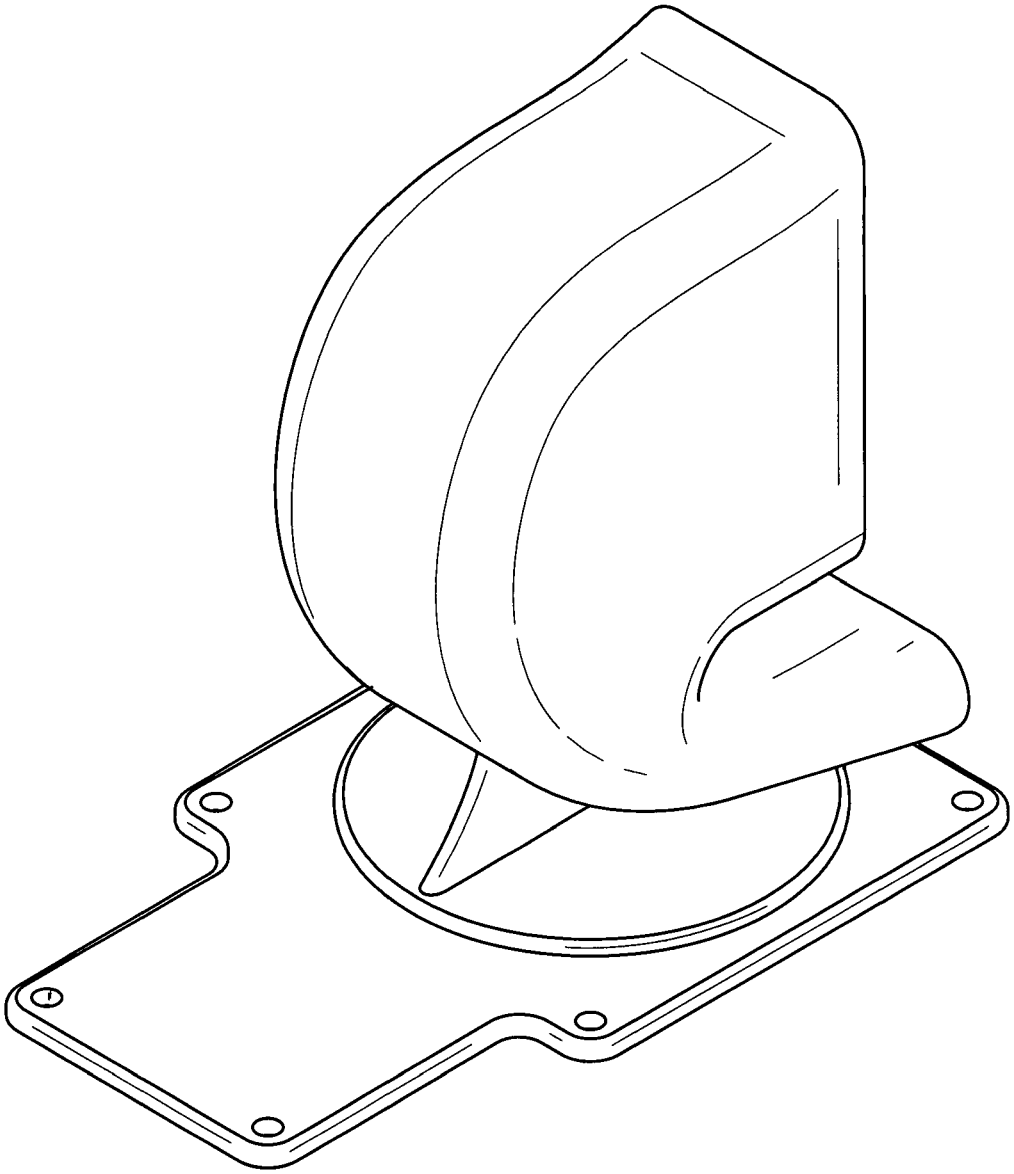
FIG. 5 is a rear perspective view of the present invention.
Figure 6:
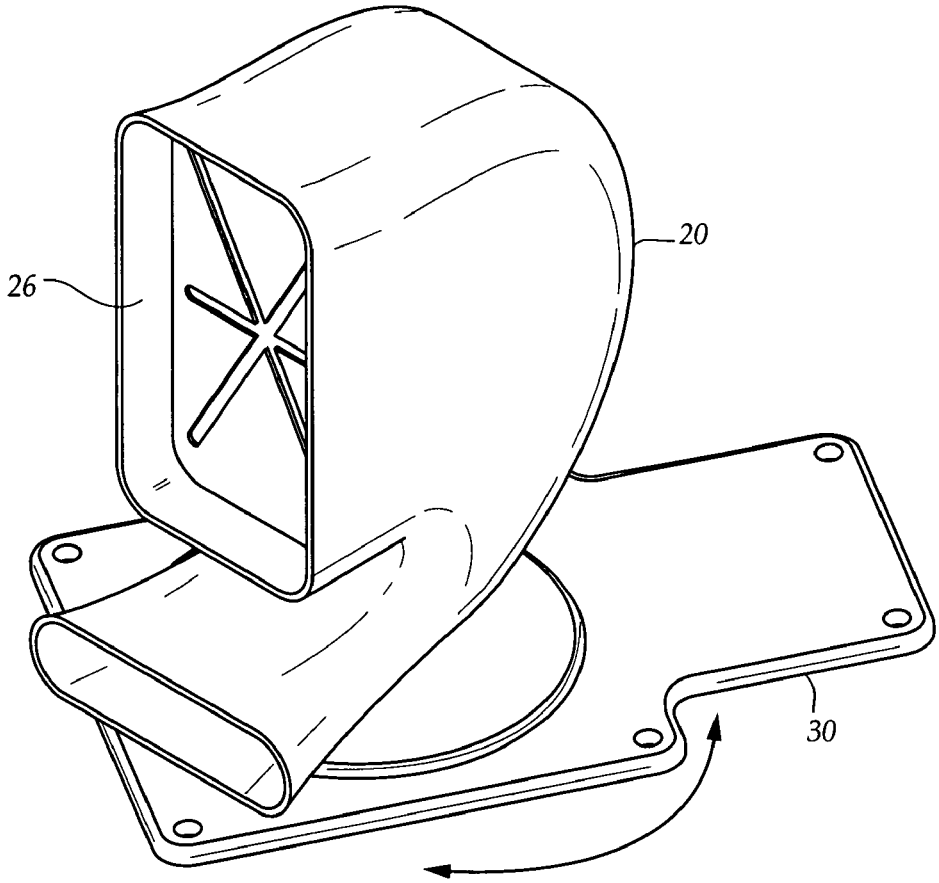
FIG. 6 is a diagrammatic perspective view, wherein the main part of the present invention has been rotated with respect to the base plate.

As seen in FIG. 3 and FIG. 5, the stand 24, has a support rib 25 and a turntable 27. Referring to FIG. 4, the turntable 27 is rotatably mounted to the base plate 30 with an axle pin 29. The axle pin 29 allows the main part 20 to rotate with respect to the base plate 30, as illustrated in FIG. 6. The rotation of the main part 20 allows the intake opening 26 to be directed at a player on the field, who is about to attempt to through a ball into the intake opening 26. It should be noted that various means can be employed to facilitate rotation of the main part 20 with respect to the base plate 30, and accordingly is not limited to the configuration with the axle pin 29, as shown in FIG. 4.

Figure 7:
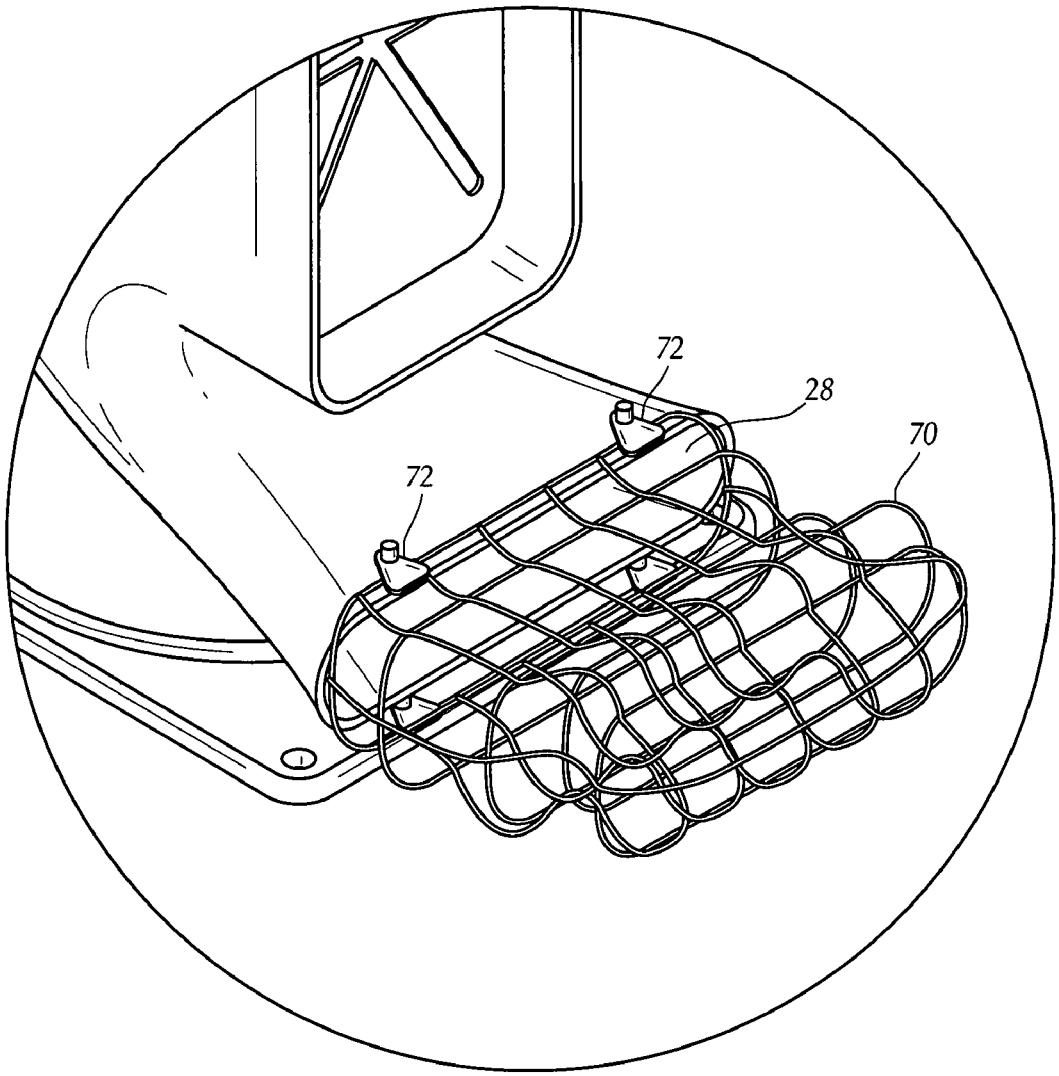
FIG. 7 is a diagrammatic perspective view of a further embodiment of the invention, wherein a ball catching net is secured over the exit port.

FIG. 7 illustrates a further embodiment of the invention, for allowing balls to be retained by the target receptacle 10 until manually retrieved. In particular, a ball bag 70 is attached to the exit port 28 with a plurality of clips 72. The clips 72 are located atop and beneath the exit port 28, and selectively allow the ball bag to be attached, so that balls exiting the exit port 28 are collected therein, and detached, to allow removal of the balls collected therein. The ball bag 70 is preferably made of a netting material, as shown, to allow balls collected therein to be clearly seen from a distance.

Figure 8:
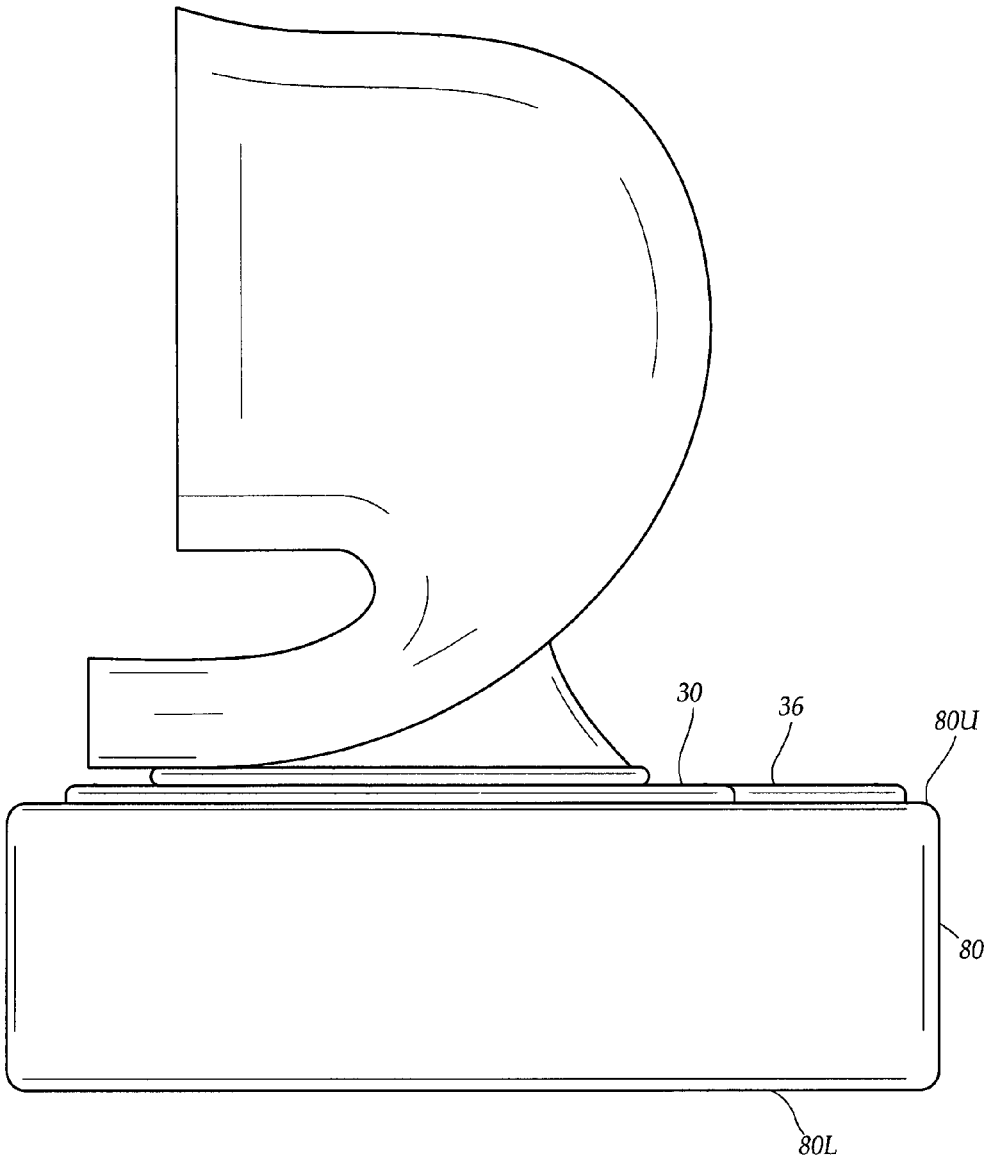
FIG. 8 is a side elevational view of a further embodiment of the invention, wherein a riser has been installed beneath the base plate.

FIG. 8 illustrates a still further embodiment of the invention, further including a riser box 80. The riser box 80 has an upper surface 80U, upon which the base plate 30 rests, and has a lower surface 80L, which rests upon the ground surface. The riser box 80 is sized to be slightly larger than the base plate 30, including the support extension 36. The purpose of the riser box is to raise the intake opening, to facilitate training baseball players to throw the ball to other players, such as when fielding and subsequently making 'plays'. Accordingly, the riser box 80 is placed upon the ground, and the base plate placed upon it prior to practicing relaying or otherwise throwing the ball between players. The riser box 80 can contain provisions for allows the base plate 30 to secure directly to the upper surface 80U such as using the stake holes 32 (which are seen in FIG. 1) and clips, pins or the like. The riser box 80 itself can also be configured so that it can stake down into the ground in a similar fashion as the base plate 30 does when used alone.

In conclusion, herein is presented a target receptacle for use in training a ball player to throw and pitch the ball with precision. The invention is illustrated by example in the drawing figures, and throughout the written description. It should be understood that numerous variations are possible, while adhering to the inventive concept. Such variations are contemplated as being a part of the present invention.

What is claimed is:

1. A target receptacle, for use upon a ground surface, in training a player to throw a baseball, comprising:

a base plate, for resting upon the ground surface;

a main part mounted to the base plate, the main part having an upper portion and a stand, the upper portion having a front and a rear, a top, and a bottom, the upper portion having an intake opening oriented toward the front, the intake opening substantially rectangular, the upper portion further having an exit port oriented toward the front and located below the intake opening, a fully enclosed conduit connecting the intake opening and exit port including a concave rear wall, and a lower transition curve between the rear wall and exit port, wherein the rear wall is curved continuously with the lower transition curve toward the exit port so that when a baseball is thrown at the intake opening, it is directed by the conduit to exit through the exit port under its own power.

2. The target receptacle as recited in claim 1, wherein the main part is rotatably mounted upon the base plate, such that the main part can be rotated with respect to the base plate.

3. The target receptacle as recited in claim 2, wherein the base plate has a plurality of stake holes, to allow the base plate to be anchored into the ground surface to stabilize the base plate.

4. The target receptacle as recited in claim 3, wherein the base plate has a front and a rear, and wherein the base plate has a substantially square main portion and a rectangular support extension that extends from the rear of the base plate.

5. The target receptacle as recited in claim 4, further comprising a ball bag, for selectively covering the exit port to collect balls as they exit the exit port.

6. The target receptacle as recited in claim 5, further comprising a membrane made of a flexible material and located within the intake opening, having a center and a plurality of radial cuts, the membrane allowing a baseball to enter the intake opening when thrown thereat and selectively preventing the baseball from bouncing out of the intake opening.

7. The target receptacle as recited in claim 6, wherein the exit port is flared laterally outwardly.

8. The target receptacle as recited in claim 7, wherein the intake opening is sized substantially like the strike zone of a player.

9. The target receptacle as recited in claim 8, further comprising a riser box sized to be slightly larger than the base plate, the riser box having an upper surface for positioning beneath the base plate for raising the intake opening, and a lower surface for resting upon the ground surface.

* * * * *